United States Patent [19]

Hutchin et al.

[11] Patent Number: 4,503,336

[45] Date of Patent: Mar. 5, 1985

[54] BEAM FORMER HAVING VARIABLE DELAYS BETWEEN LED OUTPUT SIGNALS

[75] Inventors: Richard A. Hutchin, Marlboro; William C. Bradley, Sudbury, both of Mass.

[73] Assignee: Itek Corporation, Lexington, Mass.

[21] Appl. No.: 388,010

[22] Filed: Jun. 14, 1982

[51] Int. Cl.[3] ..... H01J 40/14

[52] U.S. Cl. ..... 250/578; 367/129; 367/124; 367/64; 343/372

[58] Field of Search ..... 250/578, 231 R, 237, 250/227; 73/655; 324/77; 367/129, 128, 124, 64; 343/371, 372, 375

[56] References Cited

U.S. PATENT DOCUMENTS

| | | | |
|---|---|---|---|
| 3,701,990 | 10/1972 | Tuttle | 367/129 |
| 3,890,598 | 6/1975 | Hagen et al. | 367/124 |
| 3,946,355 | 3/1976 | Bertolino | 367/129 |
| 4,115,753 | 9/1978 | Shajenko | 367/129 |
| 4,204,262 | 5/1980 | Fitelson et al. | 367/64 |
| 4,276,551 | 6/1981 | Williams et al. | 343/375 |
| 4,318,104 | 3/1982 | Enein | 343/372 |

*Primary Examiner*—David C. Nelms
*Assistant Examiner*—J. Jon Brophy
*Attorney, Agent, or Firm*—Homer O. Blair; Robert L. Nathans; Gerald H. Glanzman

[57] ABSTRACT

A beamformer device for forming at least one beam from the outputs of a sensor array, including: a plurality of radiation sources; means for providing to each radiation source a signal from an associated one of the sensors in the sensor array; a detector array of radiation-sensitive means for providing a series of spaced signals representing radiation incident from each of the radiation sources; and means for varying the delays between the spaced signals for optimizing the response of the device to a signal from a predetermined direction.

18 Claims, 16 Drawing Figures

BEAM FORMER HAVING VARIABLE DELAYS BETWEEN LED OUTPUT SIGNALS

FIELD OF INVENTION

This invention relates to a beamformer device for forming one or more beams from the outputs of a sensor array; and more particularly to such a device which transforms the outputs of the sensor array into one or more beams of radiation for subsequent processing.

BACKGROUND OF INVENTION

Conventional sonar beamformers utilize a linear array of hydrophones directly connected to a delay line to view various segments of the hydrophone sensory field in an effort to detect signals approaching from various directions.

If the signal is from a target located directly broadside to the sensor array, all of the sensors receive the signal virtually simultaneously. Consequently, there will be no delay between the time one of the sensors responds to the incoming signal and any one of the other sensors respond to the same signal. At the other extreme, the end-fire position, when the target is approaching at ninety degrees to the broadside position, the sensor closest to the target will respond to the signal first. Each subsequent sensor will then respond sequentially until the last sensor, farthest from the target responds to the signal. Consequently, there will be maximum delay between the receptions of the sensors to the signal when the target is located in this end-fire position. At positions between the two extremes the relative delay increases as the target moves from the broadside, or zero-degree position to the end-fire, or ninety-degree position. In order for all of the hydrophone outputs to be processed simultaneously, it is necessary to delay the outputs from the earlier hydrophone receptions to a greater degree than those from the later hydrophone receptions.

Conventional beamforming devices employ a delay line means to receive the sensory outputs from the hydrophone sensor array. Typically, a clock circuit is utilized to vary the rate at which the outputs are transferred through the delay line in order to provide the appropriate delay.

The clock period (delay per hydrophone) is expressed as T, where T equals the sine of the angle A of the incoming signal multiplied by the spacing, H, between the hydrophones and divided by the speed of sound, c, or $T=\sin A\,(H/c)$. The clock rate is expressed as $1/T$.

In order to view a particular segment of the hydrophone sensory field, the clock rate is adjusted to provide the optimal delay necessary to detect a signal approaching from the particular angle of attack corresponding to that segment of the hydrophone sensory field.

In order to vary the segment of the hydrophone sensory field to be viewed, the clock rate is changed to provide the optimal delay necessary to sense a signal approaching from that new segment of the hydrophone sensory field.

This device requires a substantial amount of hardware. In order to reduce the amount and cost of hardware used, a second approach utilizes a two dimensional stepped or organ-pipe charge coupled device (CCD), in which each hydrophone output is connected directly to a different step or row of the CCD. The delay of each row of the CCD increases uniformly so that all the outputs from the sensors representative of a specific signal at a predetermined angle of incidence arrive at the output of the CCD register simultaneously for processing. The clock rate that drives the CCD is adjusted, as described above, to provide the optimal delay necessary to detect a signal approaching from the particular segment of the hydrophone sensory field that is to be viewed.

If that segment of the hydrophone sensory field that is to be viewed lies in the opposite quadrant however, it would become necessary to reverse the entire interconnection between the hydrophone sensor array and the CCD. In addition, the CCD requires a special construction in a two-dimensional array to enable it to form a single beam corresponding to a single signal.

SUMMARY OF INVENTION

It is therefore an object of this invention to provide an improved beamformer device which forms a single beam corresponding to a particular signal utilizing a single linear delay line means.

It is a further object of this invention to provide such a device which can form a number of individual beams from various distinct signals utilizing several linear delay lines.

It is a further object of this invention to provide such a device which can form a number of individual beams simultaneously utilizing several linear delay lines.

It is a further object of this invention to provide such a device which optically processes the outputs from the sensor array to form the beams.

The invention results from the realization that a simple and versatile beamformer device can be constructed by converting each output from a hydrophone sensor into a beam of light projected onto a detector array of radiation-sensitive elements and providing variable delays between those outputs for optimizing the response of the device to signals approaching from one or more particular angles.

This invention features a beamformer device for forming at least one beam from the outputs of a sensor array. There is a plurality of radiation sources and means for providing to each of the radiation sources a signal from an associated one of the sensors in the sensor array. A detector array of radiation-sensitive means provides a series of spaced signals representing radiation incident from each of the radiation sources. There are means for varying the delays between the spaced signals in order to optimize the response of the device to a signal approaching from a particular direction.

In one preferred embodiment, the means for varying the delays includes optical means which vary the physical spacing of the output images; in another it includes variable clock means for driving the delay means which varies the temporal spacing of the output receptions. The radiation sources may be LEDs and the radiation-sensitive means may include CCDs, or may include a plurality of radiation sensors and a plurality of delay elements, at least one for each radiation sensor. The optical means for varying the delays may include a zoom lens for varying the size of the image projected from the radiation sources onto the detector array. The detector array of radiation-sensitive elements may include a plurality of delay elements arranged in a row corresponding to the beam to be formed.

The means for varying the delays may include means for generating a separate bar of radiation from each of the radiation sources and projecting those bars of radiation each at a unique angle onto the detector array, with all of the lines superimposed and intersecting at a common point. The detector array of radiation-sensitive means may include a plurality of delay elements arranged in a plurality of rows and columns, each row corresponding to a different beam to be formed in optimum response to a signal from a predetermined direction.

DISCLOSURE OF PREFERRED EMBODIMENT

Other objects, features and advantages will occur from the following description of a preferred embodiment and the accompanying drawings, in which.

Figure 1:
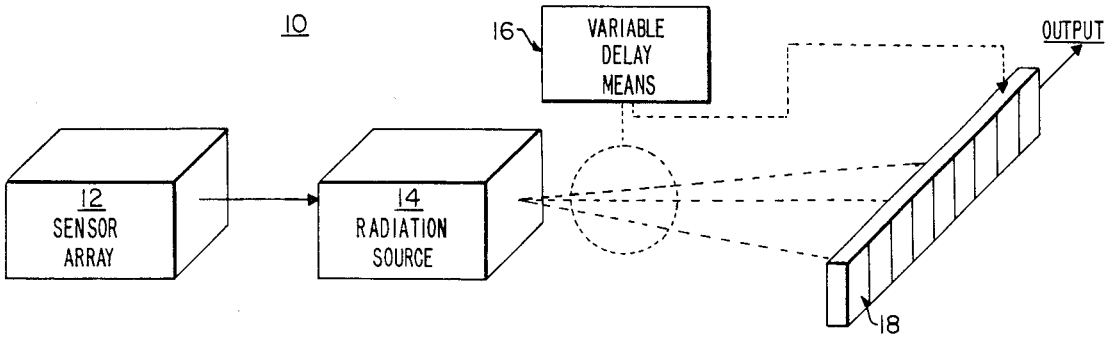
FIG. 1 is a block diagram of a beamformer device according to this invention.
Figure 3A:
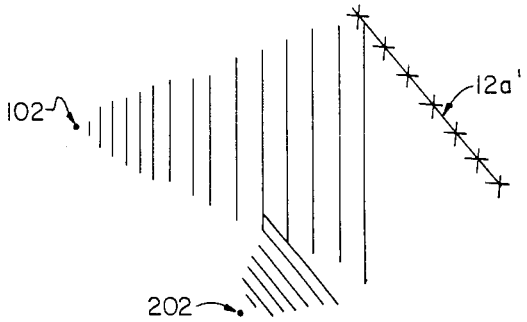
FIGS. 3A and 3B are drawings which explain the erroneous output that can result from a signal source not within the current beam of interest.
Figure 3B:
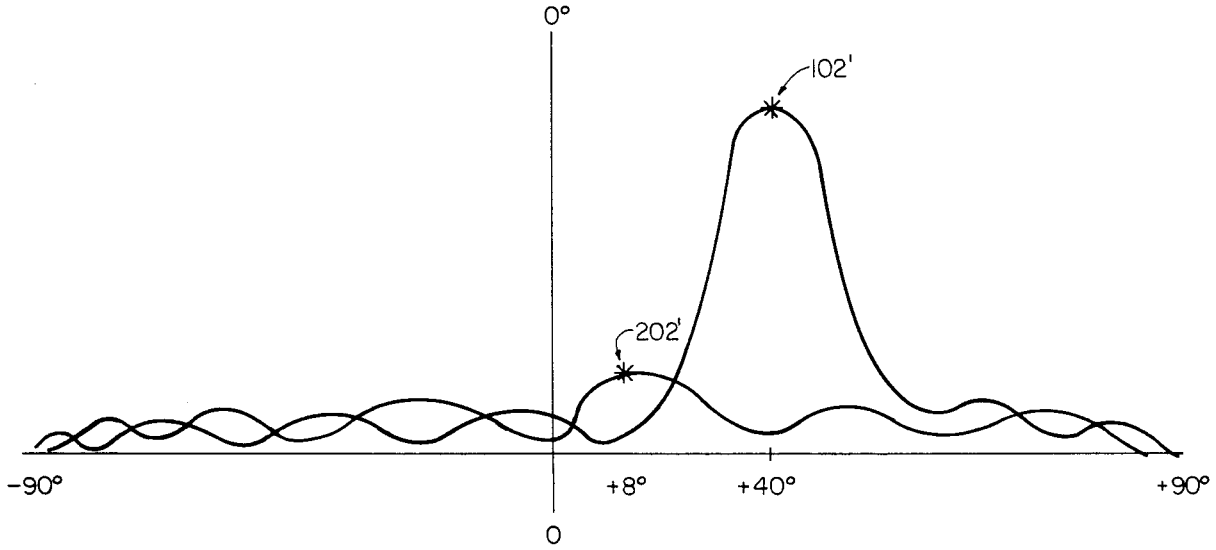
Figure 4A:
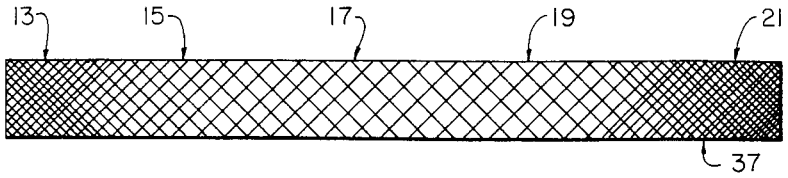
Figure 4B:
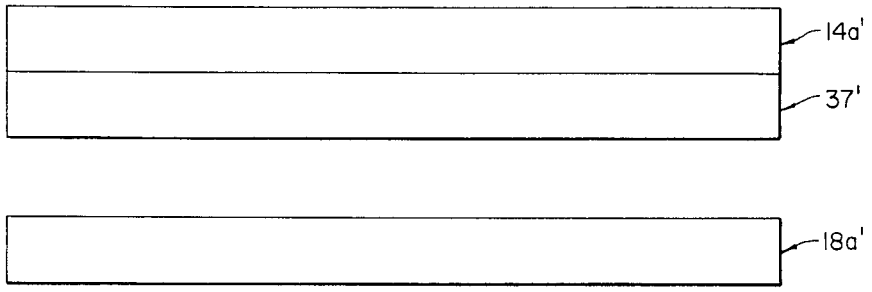
Figure 4C:
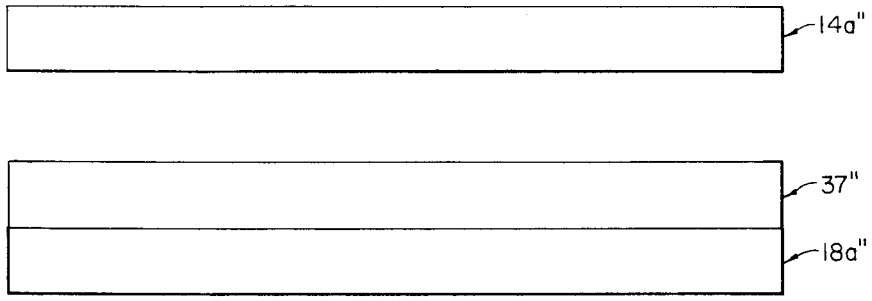
Figure 5:
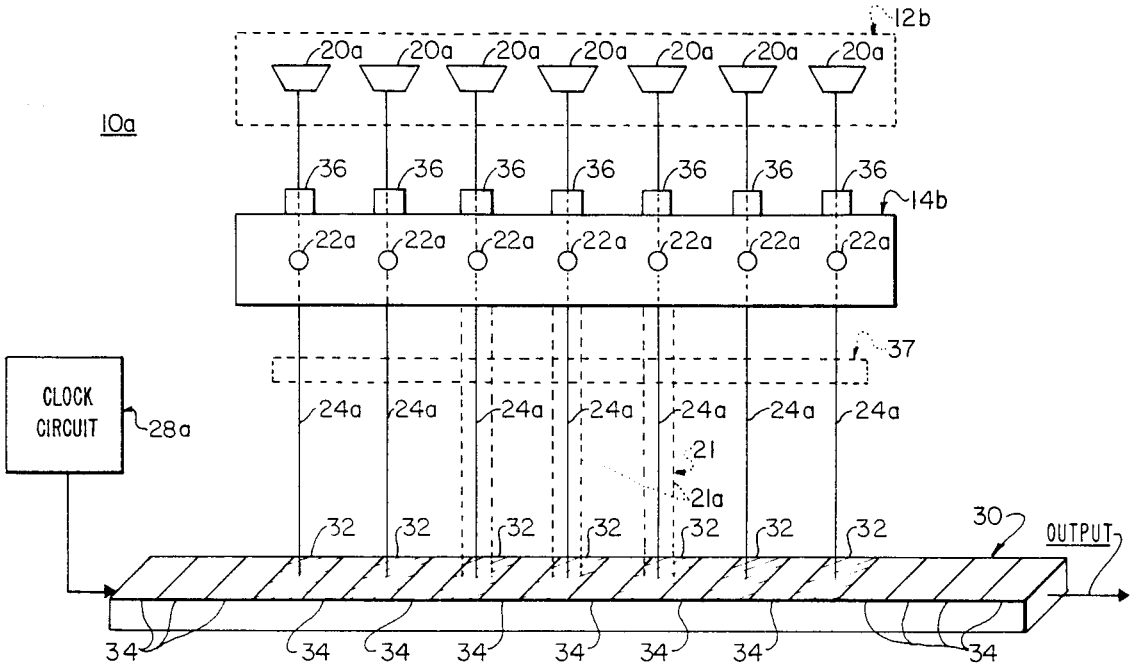
Figure 6:
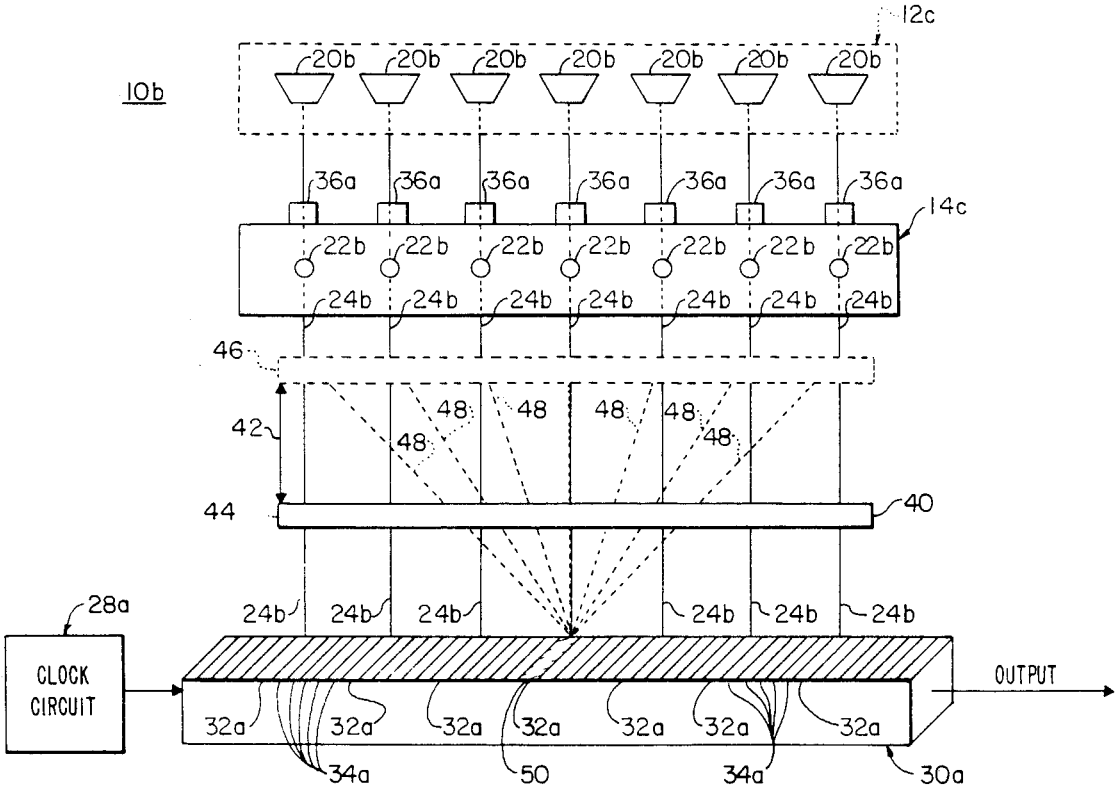
Figure 8:
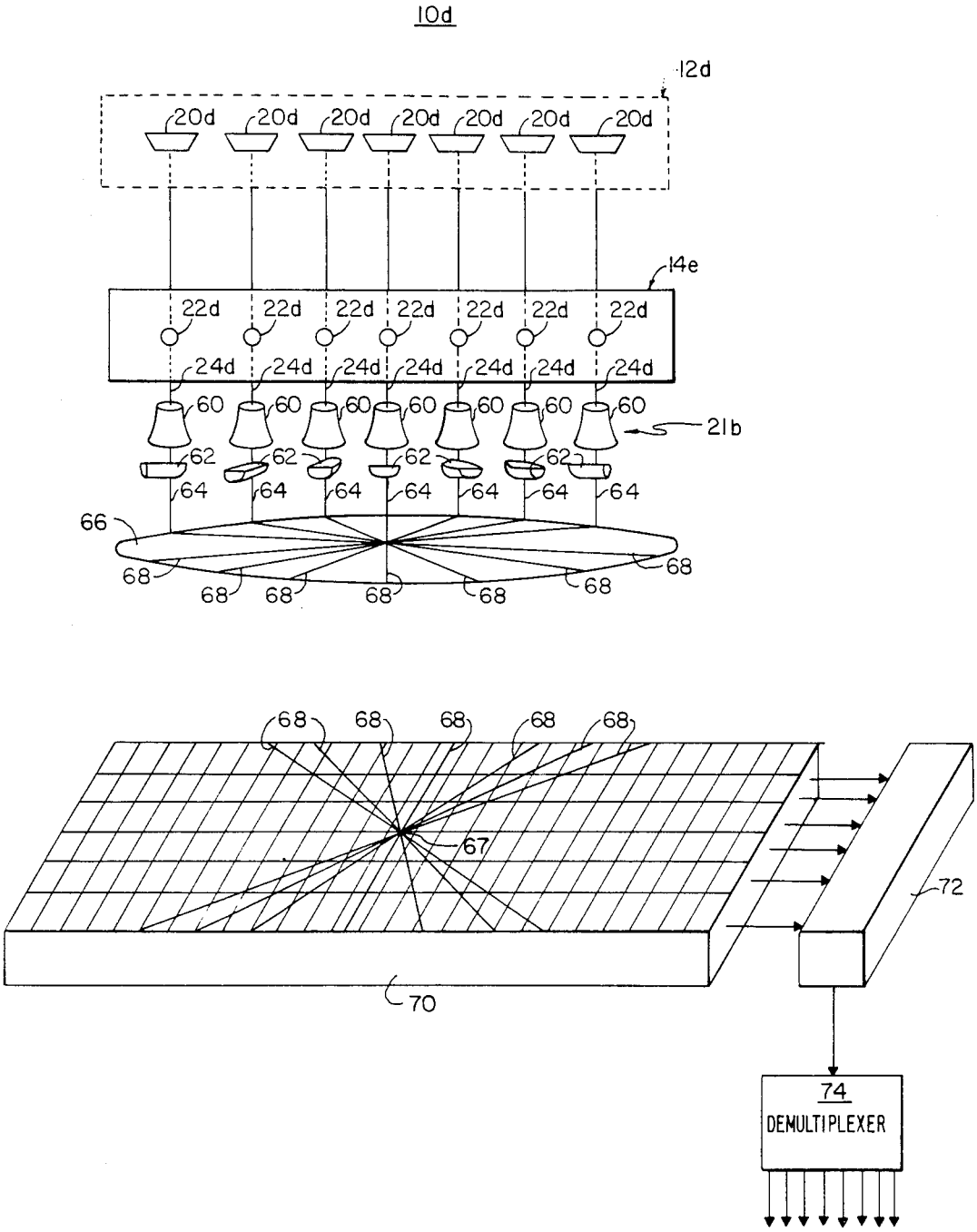
Figure 9A:
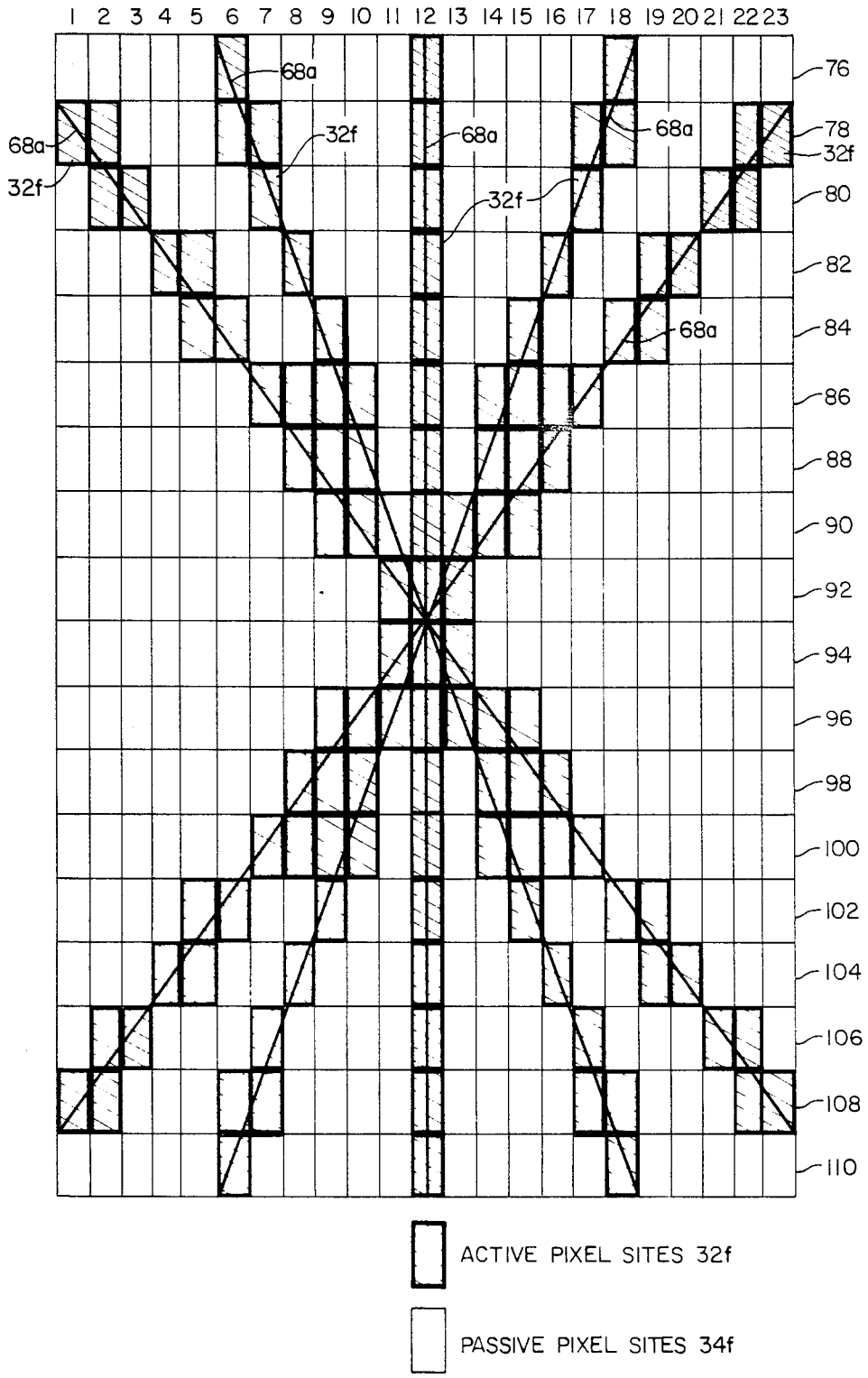
Figure 9B:
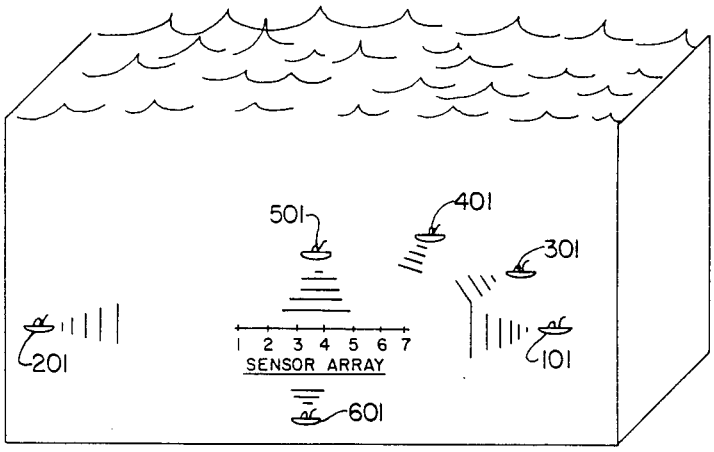

FIGS. 4A, 4B, and 4C depict the use and application of an attenuating mask as one solution to the problem shown in FIGS. 3A and 3B;

FIG. 5 is a detailed diagram of a second construction of the device shown in FIG. 1 for forming a single beam, which employs a charge coupled device (CCD) to provide the combined functions of detection and delay;

FIG. 6 is a detailed diagram of another construction of the device shown in FIG. 5 for forming a single beam, which employs a zoom focussing lens means to provide the necessary delay;

FIGS. 7A, 7B, 7C, and 7D are a series of diagrams which explain the function of the zoom lens in relation to the actual hydrophone sensory field;

FIG. 8 is a diagramatic, partially perspective view of a multi-beam beamformer device according to this invention;

FIG. 9A is a more detailed diagram of a portion of the device shown in FIG. 8 showing the intersecting light bars projected onto the two dimensional charge coupled device (CCD); and FIG. 9B is a diagram which explains the relation of the intersecting light bars to the actual hydrophone sensory field.

There is shown in FIG. 1, a beamformer device 10 for forming at least one beam from the outputs of a sensor array. Each hydrophone output from the sensor array 12 energizes a separate element in radiation source component 14, which produces a radiation output, which is then projected onto a linear detector array 18 consisting of a number of photosensitive elements. Radiation source 14 may include suitable means such as lenses to project the radiation to detector array 18. In this embodiment, the radiation output is visible. Variable delay means 16 varies the delay between the series of outputs incident on detector array 18 either by direct modification of the radiation output or electronically through detector array 18. The output of the photosensitive elements of detector array 18 is representative of the actual hydrophone sensor receptions to signals approaching from one or more selected angles.

Figure 2:
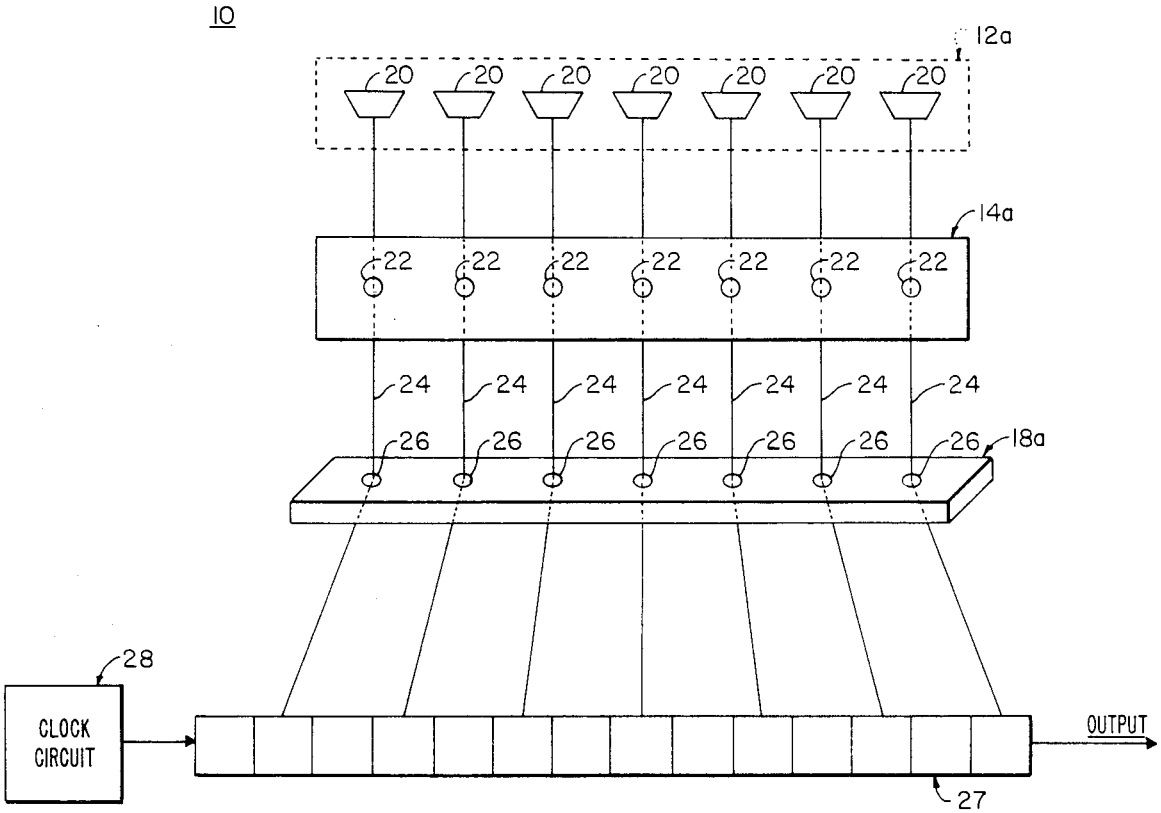
FIG. 2 is a detailed diagram of one construction of the device shown in FIG. 1 for forming a single beam, which utilizes a separate detector array and delay means.

The more detailed diagram of beamformer device 10*a* in FIG. 2 shows that each of the hydrophone sensors 20 is connected by a lead to a separate radiation source element 22 in radiation source component 14*a*. Each of the radiation source elements 22 is energized in relation to the actual hydrophone sensor output delivered to it, and produces a radiation output of light beams 24. The light beams 24 are projected onto a linear detector array 18*a* of photosensitive elements 26.

In order to view signals approaching from a number of different angles, it is necessary to vary the delay between the detections of the radiation outputs 24 that are projected onto the linear detector array 18*a*. The necessary delay is effectuated in this embodiment, by a conventional delay line 27 which is sequenced by clock circuit 28. The delay line 27 provides the appropriate delay to the output from linear detector array 18*a*. Alternatively, the appropriate delay could be provided to the outputs from the plurality of radiation source elements.

FIGS. 3A and 3B depict a problem that can occur when the delay is varied in order to optimize the response of the device to a signal approaching from a particular angle. When the appropriate delay is provided to view a segment of the hydrophone sensory field, an optimization of that particular beam angle is effectuated. In addition the sensitivity from all other beam angles is reduced. If however, a source exists which is either considerably stronger or closer to the sensor array than those sources within the beam of interest, the signal from the erroneous source may approach or exceed the signals from the sources within the beam of interest.

FIG. 3A shows that when the proper delay is provided to view a beam at 40 degrees from the sensor array 12*a*′ at position 102, a particularly strong signal approaching from position 202, not within the beam of interest, could result in erroneous or confusing output from the sensor array. In order to prevent this erroneous output, it is necessary to weight or shade the outputs of the hydrophone sensors at the ends of the sensor array.

FIG. 3B depicts the relation of the two signal to each other. When the beamformer device is adjusted to provide the optimal delay necessary to detect a target approaching at 40 degrees to the sensor array, the signal at position 102′ of FIG. 3B is within the current beam of interest. The signal at position 202′ from a target approaching at 8 degrees to the sensor array is not within the current beam of interest and must be suppressed to prevent erroneous output.

One method to weight or shade the hydrophone outputs from signals that are not in the beam of interest, is to subject each of the inputs of the radiation source elements to a variable gain resistor or potentiometer in order to electronically vary the amplitude or intensity of the radiation source outputs. The actual adjustment could occur manually or automatically.

A second method to weight or shade the hydrophone outputs from signals that are not in the beam of interest is by the introduction of an attenuating mask or transmission filter in the line of projection of the radiation source outputs. FIG. 4A depicts the attenuating mask 37, which is structured such that it is shaded progressively more intensely towards the edges at positions 13 and 21 than at the center position 17, where it is virtually clear. For example, positions 13 and 21 are considerably darker than positions 15 and 19, which are darker than position 17.

The mask or transmission filter can be positioned any where within the line of projection of the radiation source outputs. It can be affixed to the radiation source component 14*a'* as shown in FIG. 4B, or it can be attached to the detector array 18*a''* as shown in FIG. 4C.

A second embodiment of beamformer device 10*a* is shown in FIG. 5, which employs a charge coupled device (CCD) to provide the combined functions of detection and delay. Each of the hydrophone sensors 20*a* is connected by a lead to a separate radiation source element 22*a* in radiation source component 14*b*. Each of the radiation source elements 22*a* is energized in relation to the actual hydrophone sensor output delivered to it, and produces a radiation output of light beams 24*a*. The light beams 24*a* are projected onto a linear charge coupled device (CCD) 30 which is responsive to the radiation output. Alternatively, fiber-optic couplers 21*a* could be used to project the light beams 24*a* onto the CCD 30.

In this embodiment, the delay is provided by clock circuit 28*a* which controls the rate at which the charges are transferred through the linear CCD 30. The CCD pixels 32 that are activated by the light beams 24*a* are representative of the actual hydrophone sensor outputs. The clock circuit 28*a* provides the appropriate delay necessary to view a particular segment of the hydrophone sensory field. Alternatively, the radiation source elements 22*a* or the fiber-optic couplers 21*a* could be repositioned to alter the ultimate destination of the light beam images on the CCD 30, in order to provide the appropriate delay.

The output is processed by looking for a signal band characteristic of a particular target, e.g. supertankers have a 20 hz frequency signal. A power spectrum density analysis is performed as a function of frequency for each given velocity of charge transfer through the CCD. If the output is in phase with a given velocity of CCD charge transfer, the particular target or signal source lies in the beam which is represented by that particular clock rate.

The clock rate is defined as follows;

$$R = c(n)/l(\sin A)$$

where;

c = the speed of sound, n = the number of CCD pixel sites,

A = the angle of the approaching signal wavefront, l = the length of actual hydrophone array.

In order to prevent the erroneous output that can occur when a strong source signal exists at a location other than the beam angle presently of interest, it is necessary to weight or shade the hydrophone outputs that are not in the beam direction of present interest. The device depicted in FIG. 5 includes manual gain adjustment means 36 which can vary the amplitude of each radiation source element 22*a* to provide the necessary shading. Alternatively, this shading could be accomplished by the introduction of a transmission filter 37 as shown in FIG. 4A, positioned in the line of projection of light beams 24*a*.

Another embodiment of beamformer device 10*b* is shown in FIG. 6, which includes a means for projecting the radiation to the detector array, a zoom focussing lens, to provide the appropriate delay in conjunction with the linear charge coupled device (CCD). Each hydrophone sensor 20*b* is connected by a lead to a separate radiation source element 22*b* in radiation source component 14*c*. Each of the radiation source elements 22*b* is energized in relation to the actual hydrophone sensor output delivered to it, and produces a radiation output of light beams 24*b*. The amplitude or intensity of each light beam 24*b* varies in relation to the hydrophone sensor output delivered to each radiation source element 22*b*.

These light beams 24*b* are projected onto a linear charge coupled device (CCD) 30*a* through lens means 40 which includes zoom focussing capabilities for varying the size of the image projected onto the linear CCD. The delay necessary to view signals approaching from a number of different angles is provided by focussing the lens means 40 to effectively alter the ultimate destination of each image projected by the light beams 24*b* onto the linear CCD 30*a*. Zoom lens means 40 can be focussed as shown by directional arrow 42 in relation to the segment of the actual hydrophone sensory field that is to be viewed. When lens means 40 is focussed to the extreme descendant position 44, the light beams 24*b* are projected parallel to each other onto the linear CCD 30*a*. This results in a maximum number of passive pixel sites 34*a* between those pixel sites 32*a* that are illuminated by the light beams 24*b*. This would cause a maximum delay between light beam detections and would be representative of the end-fire segment of the hydrophone sensory field where each subsequent sensor reception would have maximum delay.

Conversely, when lens means 40 is focussed to the extreme ascendant position 46, the light beams 48 converge towards each other. Consequently, all of the light beams 48 are focussed onto a single pixel 50 at the center of CCD 30*a*. This results in only one active pixel site 50, causing simultaneous output with no delay between light beam detections. This would be representative of the broadside segment of the hydrophone sensory field where all of the actual hydrophone sensor receptions to a target would be virtually simultaneous.

When lens means 40 is focussed intermediately between positions 44 and 46, the light beams will be focussed variably such that the images will be projected onto CCD 30*a* with a variable number of passive pixel sites 34*a* between those sites 32*a* that are illuminated by the light beam images. The number of passive pixel sites 34*a* is proportional to the optimal delay necessary to sense a signal from that particular segment of the hydrophone sensory field that is to be viewed.

In this embodiment, clock circuit 28*a* remains constant because the appropriate delay necessary to view signals approaching from a number of different angles is synthesized optically by varying the ultimate destination of each image projected upon the charge coupled device (CCD) 32*a*. By varying the distance between the light beam images projected onto the linear charge coupled device 32*a* as described above, the relative delay between receptions of the light beam images in the series is effectively altered.

As the charge packets are clocked across the pixels of the charge coupled device (CCD) 30*a* by clock circuit 28*a*, the output is proportional to the radiation incident upon the pixel sites 32*a* of the CCD 30*a*, and is representative of the output from the actual hydrophone sensor array.

The output is then processed by looking for a band characteristic of a particular target, e.g. supertankers have a 20 hz frequency signal. A power spectrum density analysis is performed as a function of frequency for each particular zoom focus condition. If the output is in phase with a given zoom focus condition, the target or signal source lies in the beam which is represented by that particular zoom focus condition.

The device depicted in FIG. 6 includes manual gain adjustment means 36*a* which can vary the amplitude of each radiation source element 22*b* in order to prevent the erroneous output that can occur when a strong source signal exists at a location other than the beam angle presently of interest. Alternatively, this adjustment can be accomplished by the introduction of a transmission filter as shown in FIG. 4A, positioned in the line of projection of the light beams 24*b*. Beams 24 and 48 in FIGS. 6, 7,B, C and D are drawn to the edge rather than the center of the sites 22 for clarity to eliminate confusion of the lines.

Figure 7A:
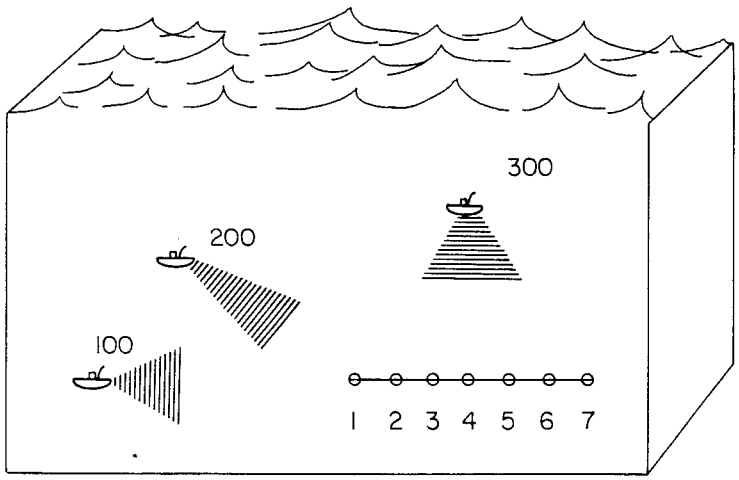
Figure 7B:
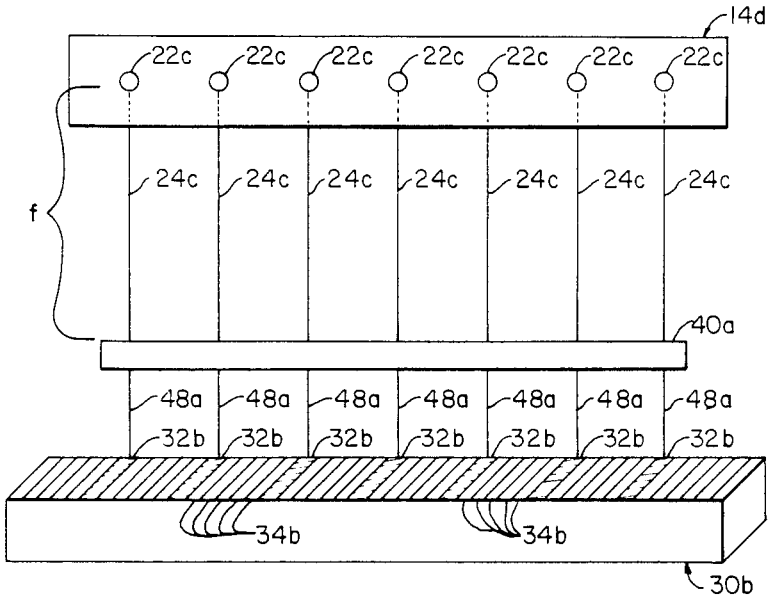

FIGS. 7A, 7B, 7C, and 7D represent the relation of the projected radiation images to the actual sensor array. When it is desired to view a beam which is end-fire (ninety degrees) to the actual sensor array, as depicted by position 100 in FIG. 7A, the lens means is focussed as shown in FIG. 7B. This causes the light beams 48*a* to be projected onto pixel sites 32*b* of the charge coupled device (CCD) 30*b*. The delay between receptions of the light beams is proportional to the number of passive pixel sites 34*b* between those pixel sites 32*b* which are illuminated by the series of light beams 48*a*. In this situation, the number of intermediate passive pixel sites 34*b* is representative of a maximum delay.

Figure 7C:
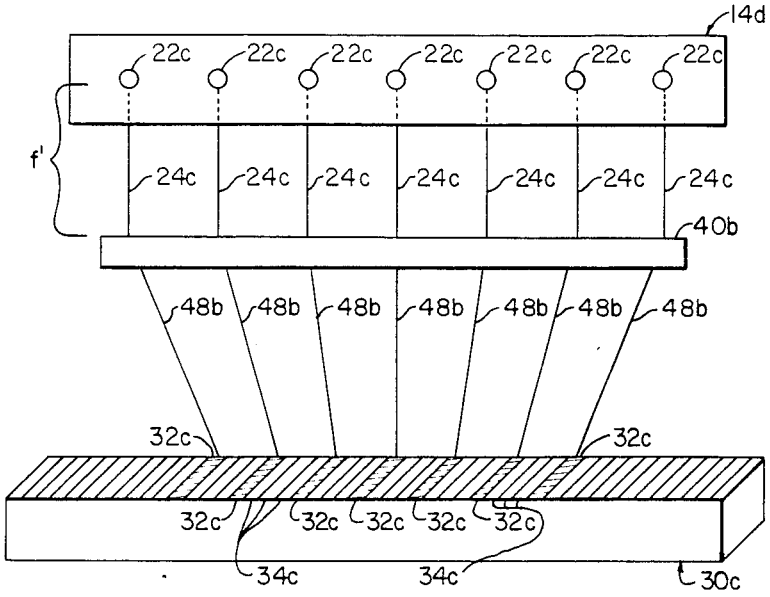

Likewise, in order to view a beam which is mid-distance between the broadside and end-fire positions, i.e. position 200 in FIG. 7A, the lens means would be focussed as shown in FIG. 7C. Because the focal length f is considerably reduced, the light beams 48*b* will converge towards each other projecting the images onto pixel sites 32*c* of CCD 30*c*. The number of passive pixel sites 34*c* between those pixel sites 32*c* that are illuminated provides the optimal delay necessary to view signals approaching from position 200 in FIG. 7A.

Figure 7D:
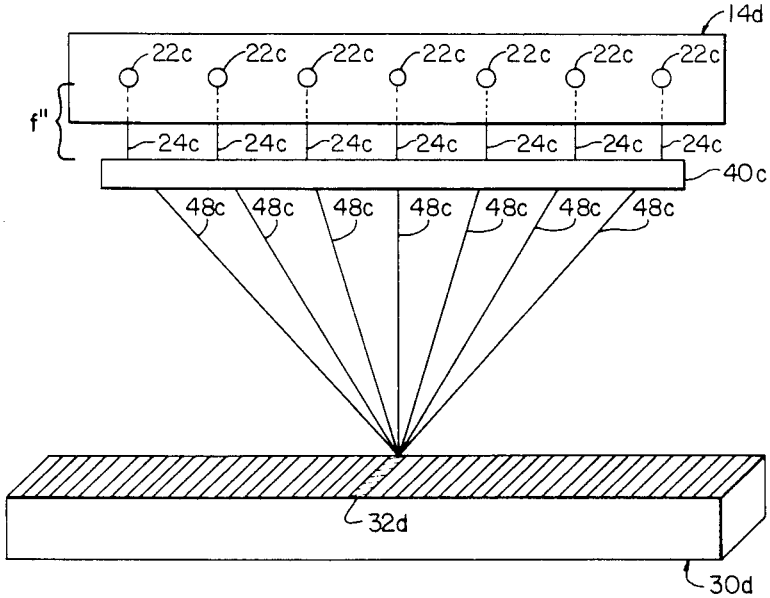

In order to view a beam which is broadside (zero degrees) to the actual sensor array, i.e. position 300 in FIG. 7A, the lens means is focussed as shown in FIG. 7D. Because the focal length f is considerably reduced again, the light beams 48*c* will converge to an even greater degree until all of the light beam images are focussed onto a single pixel 32*d* in the center of CCD 30*d*. In this case there will be no delay between receptions of the light bars because there are no passive pixel sites between the only pixel site 32*d* that is illuminated by the light beams 48*c*. This is because all of the actual hydrophone sensor receptions would be virtually simultaneous if the signal were approaching from position 300 in FIG. 7A.

When it is desired to view a beam that occurs at some position other than those discussed above, the lens means is focussed appropriately so that the number of passive pixel sites between those sites that are illuminated by the light beams provides the optimal delay necessary to sense signals approaching from that particular segment of the actual hydrophone sensory field that is desired to be viewed.

FIG. 8 is a diagram of a multi-beam embodiment of the beamformer device 10*d* which is capable of viewing a plurality of different beams simultaneously. Each of the hydrophone sensors 20*d* is connected by a lead to a separate radiation source element 22*d* in radiation source component 14*e*. Each of the radiation source elements 22*d* is energized in relation to the actual hydrophone sensor output delivered to it, and produces a radiation output of light beams 24*d*.

The light beams 24*d* are projected through a series of lenses. Collimating lenses 60 cause each light beam 24*d* to remain concentrated, preparing each beam for the next optical alteration by preventing the beam from diverging. Cylindrical lenses 62 provide a bar of radiation 68, from each concentrated light beam. Each of the cylindrical lenses 62 is positioned asymetrically causing the bar images to extend in various directions from the center points. These light bars are then projected onto the aperture of large lens 66, which focusses these bars of radiation 68 each superimposed at a unique angle onto a two dimensional charge coupled device (CCD) 70 with all of the lines intersecting at a common point 67 as shown in FIG. 8.

The output from each row of the two dimensional CCD 70 is delivered to output register 72 which processes and delivers a serial input to demultiplexer 74 which converts the serial input to a parallel output representative of the actual hydrophone output.

FIG. 9A is a more detailed drawing of the two dimensional charge coupled device (CCD) 70 in FIG. 8, which shows that the bars of radiation 68*a* are each focussed at a unique angle onto CCD 70*a* with all of the bars intersecting at a common point.

Each light bar 68*a* is representative of a particular hydrophone sensor and will be illuminated in proportion to the actual hydrophone sensor output delivered to the appropriate radiation source element.

Each row 76–110 of the two dimensional CCD 70*a* views a separate beam or segment of the hydrophone sensory field and will deliver an output proportional to the amount of radiation incident upon the pixels in that row of the CCD. For example, row 76 views the end-fire position that lies ninety degrees from the actual hydrophone sensor array as shown at position 101 in FIG. 9B. The number of passive pixel sites 34*e* between those pixel sites 32*e* that are illuminated by the light bars is maximum in this row. This is because the delay between actual hydrophone receptions to a signal approaching from this end-fire position, would be maximum. If a particular light bar illuminates two adjacent pixel sites, the CCD will receive a portion of the charge (typically $\frac{1}{2}$) one pixel time delay early and the remaining portion of the charge one pixel time delay late. The resulting average provides the appropriate delay.

Similarly, the opposite end-fire position that lies 270 degrees from the actual hydrophone sensor array at position 201 in FIG. 9B, is viewed by row 110 of the two dimensional CCD array 70*a* in FIG. 9A. The delay between receptions i.e. the number of intermediate passive pixel sites 34*f*, in this situation is equal to the end-fire position described above. The order of receptions however, is reversed to accomodate the actual order of hydrophone receptions that would occur from a signal approaching from position 201 in FIG. 9B.

This reverse reception capability exists throughout the entire two dimensional CCD array in order to enable the device to view beams in every quadrant of the actual hydrophone sensory field.

Row 80 of CCD 70*a* views a beam at position 301 in FIG. 9B, and the number of intermediate passive pixel sites 34*f* in that row is directly proportional to the actual time delay that would occur between actual hydrophone receptions to a signal approaching from that position.

Row 86 of CCD 70*a* views a beam at position 401 in FIG. 9B, and the number of intermediate passive pixel sites 34*f* in that row is directly proportional to the actual time delay that would occur between actual hydrophone receptions to a signal approaching from that position.

Row 92 and 94 of CCD 70*a* view beams at either broadside position 501 or 601 (zero or one hundred eighty degrees to the actual hydrophone sensor array). There are no intermediate passive pixel sites 34*f* in this row because there is virtually no delay between actual hydrophone receptions to a signal approaching from these positions.

The output of each row of the two dimensional CCD 70*a* in FIG. 9A can be correlated with the output of the zoom lens embodiment pictured in FIGS. 7A, 7B, 7C, and 7D as follows: row 76 output is equal to the output of CCD 30*b* in FIG. 7B; row 82 output is equal to the output of CCD 30*c* in FIG. 7C; row 92 output is equal to the output of CCD 30*d* in FIG. 7D;

All of the intermediate beams not shown in FIGS. 7A–7D can be similarly correlated with an output from each row of the two dimensional CCD array 70*a* pictured in FIG. 9A.

Other embodiments will occur to those skilled in the art and are within the following claims:

What is claimed is:

1. A beamformer device for forming at least one beam from the outputs of a sensor array, comprising:

a plurality of radiation sources;

means for providing to each said radiation source a sensor signal from an associated one of the sensors in said sensor array;

a detector array of radiation-sensitive means for providing a series of spaced signals, each spaced signal representing radiation incident from a particular one of said radiation sources; and means for varying the delays between said spaced signals for optimizing the response of said device to a signal from a predetermined direction.

2. The beamformer device of claim 1 in which said means for varying the delays includes optical means.

3. The beamformer device of claim 1 in which said means for varying the delays includes variable clock means.

4. The beamformer device of claim 1 in which said radiation sources provide visible radiation.

5. The beamformer device of claim 1 in which said radiation sources are LED's.

6. The beamformer device of claim 1 in which said radiation-sensitive means includes CCD's

7. The beamformer device of claim 2 in which said optical means includes a zoom lens for varying the size of the image of said radiation sources on said detector array.

8. The beamformer device of claim 1 in which said radiation-sensitive means includes a plurality of radiation detectors and a plurality of delay elements, at least one said element for each radiation detector.

9. The beamformer device of claim 1 in which said means for varying the delays includes means for generating a separate bar of radiation for each of said radiation sources and projecting those bars of radiation each superimposed at a unique angle onto said detector array with all of said lines intersecting at a point.

10. The beamformer device of claim 9 in which said detector array of radiation sensitive means includes a plurality of delay elements arranged in a plurality of rows and columns, each row corresponding to a different beam to be formed in optimum response to a signal from a predetermined direction.

11. The beamformer device of claim 1 in which said plurality of radiation sources include a plurality of radiation elements and means for projecting radiation to said detector array.

12. The beamformer device of claim 11 in which said means for projecting includes fiber-optic means.

13. The beamformer device of claim 1 furthur including means for adjusting the intensity of said radiation source outputs to said detector array.

14. The beamformer device of claim 13 in which said means for adjusting includes electronic gain control means.

15. The beamformer device of claim 13 in which said means for adjusting includes transmission filter means.

16. A beamformer device for forming at least one beam from the outputs of a sensor array, comprising:

a plurality of radiation sources;

means for providing to each said radiation source a signal from an associated one of the sensors in said sensor array;

a detector array of radiation-sensitive means for providing a series of spaced signals representing radiation incident from each of said radiation sources; and optical means responsive to said radiation sources for varying the size of the image of said radiation sources on said detector array for varying the delays between said spaced signals for optimizing the response of said device to a signal from a predetermined direction.

17. A beamformer device for forming at least one beam from the outputs of a sensor array, comprising:

a plurality of radiation sources;

means for providing to each said radiation source a sensor signal from an associated one of the sensors in said sensor array;

a detector array of radiation-sensitive means for providing a series of delayed signals, each delayed signal representing radiation incident from a particular one of said radiation sources; and clock means for varying the delays between said spaced signals for optimizing the response of said device to a signal from a predetermined direction.

18. A beamformer device for forming a number of beams from the outputs of a sensor array, comprising:

a plurality of radiation sources;

means for providing to each said radiation source a signal from an associated one of the sensors in said sensor array;

a detector array of radiation-sensitive means having a plurality of delay elements arranged in a plurality of rows and columns, each row corresponding to a different beam to be formed in optimum response to a signal from a predetermined direction, for providing a series of spaced signals in each row representing radiation incident from each of said radiation sources; and optical means for generating a separate bar of radiation for each of said radiation sources and projecting those bars of radiation each at a unique angle of projection onto said detector array with all of said lines intersecting at a point for providing different delays between said spaced signals in each row to optimize the response of said device to a signal from a number of different directions corresponding to the number of rows.

* * * * *